United States Patent [19]

Vernooij et al.

[11] Patent Number: 4,644,226

[45] Date of Patent: Feb. 17, 1987

[54] DISCHARGE LAMP CIRCUIT HEAT-SINKED TO THE LAMP CAP

[75] Inventors: Marinus G. Vernooij; John A. J. Daniels, both of Eindhoven, Netherlands

[73] Assignee: U.S. Philips Corporation, New York, N.Y.

[21] Appl. No.: 863,824

[22] Filed: May 13, 1986

Related U.S. Application Data

[63] Continuation of Ser. No. 705,769, Feb. 26, 1985, abandoned.

[30] Foreign Application Priority Data

Feb. 29, 1984 [NL] Netherlands ..... 8400631

[51] Int. Cl.[4] ..... H01J 17/28

[52] U.S. Cl. ..... 315/50; 313/17; 313/25

[58] Field of Search ..... 315/50, 58; 313/17, 313/22, 25

[56] References Cited

U.S. PATENT DOCUMENTS

| | | | |
|---|---|---|---|
| 4,061,939 | 12/1977 | Strok | 313/25 |
| 4,503,358 | 3/1985 | Kamei et al. | 315/58 |
| 4,570,105 | 2/1986 | Engel | 315/58 |

*Primary Examiner*—Carroll B. Dority, Jr.
*Attorney, Agent, or Firm*—David R. Treacy

[57] ABSTRACT

A high-pressure discharge lamp comprising a discharge vessel (3) enclosed by an outer envelope (1) provided with a neck (10) which is adjoined by a sleeve (20) of a lamp cap (2). The lamp cap (2) accommodates an electrical circuit provided with a semiconductor switching element (26) which controls the discharge current in the operating condition of the lamp. The semiconductor switching element (26) is provided with a cooling member (24) which is preferably secured to the sleeve (20). This lamp may be used without further expedients in combination with a stabilization ballast not adapted to the lamp.

16 Claims, 5 Drawing Figures

DISCHARGE LAMP CIRCUIT HEAT-SINKED TO THE LAMP CAP

This is a continuation of application Ser. No. 705,769, filed Feb. 26, 1985, now abandoned.

BACKGROUND OF THE INVENTION

The invention relates to a discharge lamp comprising a discharge vessel in which are arranged two electrodes, between which a discharge current flows in the operating condition of the lamp, which vessel is enclosed by an outer envelope provided with a neck which is adjoined by a sleeve of a lamp cap.

Lamps of the kind mentioned in the opening paragraph are frequently used nowadays both in public illumination and in illumination in residental rooms. These lamps have the great advantage of a comparatively high luminous flux with small dimensions as compared with incandescent lamps and low-pressure discharge lamps. The filling can consist of a combination of one or more metal vapours and one or more rare gases, or of one or more metal halides, mercury and rare gas.

Such lamps, and especially high-pressure discharge lamps, are generally operated in combination with a stabilization ballast. The value of the impedance of the ballast should be chosen to match the discharge current through the lamp in the operating condition. Consequently it is not possible to operate a lamp of one kind in an existing equipment designed for operating a different kind of discharge lamp, without making modifications to the existing equipment. This is a disadvantage because of the progressive increase in luminous efficacy in new types of high-pressure discharge lamps, and the attempts to obtain a further saving in energy.

SUMMARY OF THE INVENTION

The object of the invention is to eliminate the necessity to make modifications to existing equipment when installing a different type lamp.

For this purpose, according to the invention, a lamp of the kind mentioned in the opening paragraph is characterized in that the lamp cap accommodates an electrical circuit provided with at least one semiconductor switching element which in the operating condition of the lamp, control the discharge current, and a cooling member for that element.

By the use of a switching element controlling the discharge current, it is possible to operate the lamp in an equipment provided with a stabilization ballast not designed for the relevant lamp. When the switching element is constructed as a semiconductor switching element, the advantage is obtained of small dimensions and hence of the possibility of incorporating the element in the lamp cap. It is a surprise to find that this can be realized in practice when the semiconductor switching element is provided with a cooling member.

Lamps provided with an electrical circuit comprising one or more semiconductor elements in the lamp cap are known per se. However, in all cases these elements are non-switching elements; or at least elements not switching in the operating condition of the lamp; see, for example, Dutch Patent Application No. 80.06802 to which U.S. Pat. No. 4,441,759 corresponds. It is known that a switching semiconductor element dissipates a power having a value of approximately 1 W/A. Experiments have shown that such a power dissipation in a lamp cap of a high-pressure discharge lamp may lead to such high temperatures in the operating condition that the temperature permissible for a semiconductor element is exceeded.

A circuit arrangement provided with a switching element intended to control the discharge current during the operation of a discharge lamp is known in DIP devices. Such a circuit, in which the switching element is constructed as a semiconductor switching element, is known from U.S. Pat. No. 3,925,705. The use of the known circuits has the disadvantage that solely means are provided for a separate connection to the equipment in which the lamp should be operated.

In an advantageous embodiment of a lamp according to the invention, the cooling member is a metal body which is directly connected to the sleeve of the lamp cap.

It has been found that a sufficient heat dissipation of the semiconductor circuit element can be obtained in a very simple manner with such a construction of the cooling member, in spite of the fact that in the operating condition the sleeve of the lamp cap is generally enclosed entirely by the lamp holder, as a result of which the heat emission of the sleeve is limited.

In a further advantageous embodiment of a lamp according to the invention, the metal body comprises a plate-shaped part which is located near the neck of the outer envelope, the major surfaces of the plate-shaped part being substantially at right angles to the longitudinal axis of the lamp cap. In this manner, the plate-shaped part of the metal body acts not only as a heat-conducting cooling member for the semiconductor circuit element, but also as a heat-reflecting member for thermal radiation originating from the discharge vessel.

Many possibilities exist for securing the metal body to the lamp cap sleeve. For example, the body may be directly welded or soldered to the sleeve. In an advantageous embodiment, the metal body has a flanged edge which is secured at the area of the connection of the outer envelope to the sleeve of the lamp cap between the neck and the sleeve. This has the advantage that the cooling member can be secured to the neck of the outer envelope before the lamp cap is mounted. In this manner, the cooling member can be accurately positioned. It is also comparatively simple to mount the elements of the electrical circuit. Although, for optimum thermal conduction, it is to be preferred that the flange extends over the whole circumference of the sleeve, a flange extending over only part of the circumference of the sleeve also forms a practical usable construction.

In a further embodiment of a lamp according to the invention, in which the sleeve of the lamp cap comprises an insulating bead, the metal body is secured by means of an edge portion between the sleeve and the insulating bead of the lamp cap. Also in a construction of this form, the edge portion may cover the whole circumference or only part of the circumference of the sleeve of the lamp cap. This embodiment has the advantage that the electrical circuit can be manufactured separately from the outer envelope, as a result of which the risk of rupture of the outer envelope is reduced.

In another embodiment, the cooling member is for the major part plate-shaped, while the circumference can be resiliently compressed. The cooling member is so dimensioned that it bears on the sleeve of the lamp cap in the sleeve, in a self-clamping manner, the major surfaces of the cooling member being substantially at right angles to the longitudinal axis of the lamp cap sleeve.

An advantage of this embodiment is that manufacture of the electrical circuit can be started with the cooling member separated from both the outer envelope of the lamp and the lamp cap. Due to the fact that the cooling member is arranged in a self-clamping manner, after this member has been arranged in the sleeve of the lamp cap, a good direct contact is ensured, which also provides mechanical strength.

An embodiment of a lamp according to the invention will be described with reference to the drawings.

BRIEF DESCRIPTION OF THE DRAWING

In FIG. 1, reference numeral 1 designates an outer envelope of the lamp having a neck 10 adjoined by a sleeve 20 of a lamp cap 2. The outer envelope encloses a discharge vessel 3. The discharge vessel 3 is provided with two electrodes 4 and 5, between which a discharge current flows in the operating condition of the lamp. The electrode 4 is connected by means of a metal strip 6 to a rigid supply conductor 7. The electrode 5 is electrically connected through a metal strip 8 to a rigid supply conductor 9.

In FIG. 2, parts corresponding to those in FIG. 1 are designated by the same reference numerals. One end of the sleeve 20 of the lamp cap 2 fits around the neck 10 of the outer envelope 1. At the other end of the sleeve 20 there is arranged an insulating bead 21 provided with a connection contact 22. A recess containing an electrical conductor 90 extends through the insulating bead 21, this conductor 90 forming an electrical connection between the current supply conductor 9 and the connection contact 22. The lamp cap 2 further accommodates near the neck 10 and substantially at right angles to the longitudinal axis of the lamp cap a plate-shaped part 24 of a metal cooling member 12 which is provided with an edge flange 25. The flange 25 encircles the neck 10 of the outer envelope and is directly connected to the sleeve 20. The cooling is thus secured between the neck and the sleeve at the area of the connection of the neck of the outer envelope to the sleeve of the lamp cap. The flanged edge 25 is preferably in contact with the sleeve 20 substantially along the whole circumference of the sleeve 20. This guarantees a good thermal conduction.

Figure 1:
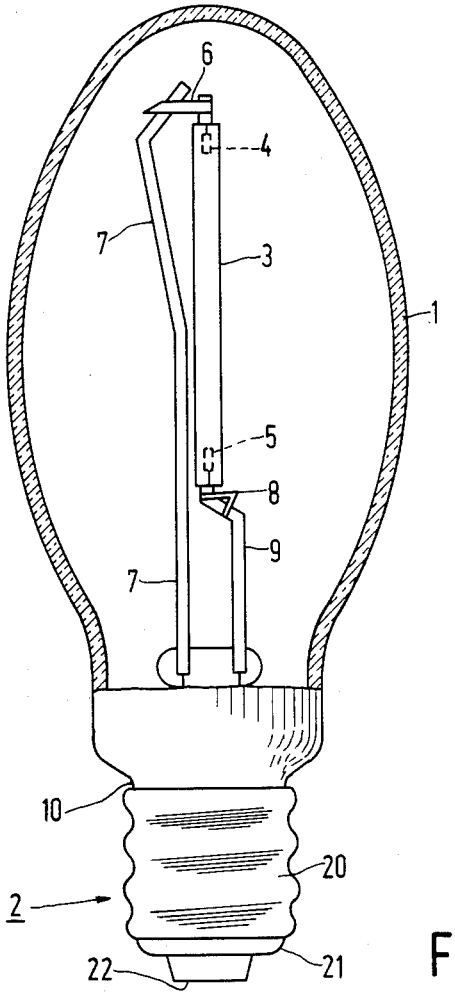
FIG. 1 is a schematic side elevation of the lamp with the greater part outer envelope of the lamp shown broken away.

By means of a clamp 31, a semiconductor switching element 26 is mounted on the side of the plate-shaped part 24 remote from the neck 10. Furthermore, a mounting plate 28 is mounted on the side of the plate-shaped part 24 remote from the neck 10 and bears components 27 of the circuit arrangement. In a manner not shown further, the circuit arrangement is electrically connected to the sleeve 20. An electrical conductor 70 ensures that an electrical connection is formed between the circuit arrangement and the current supply conductor 7.

Figure 3:
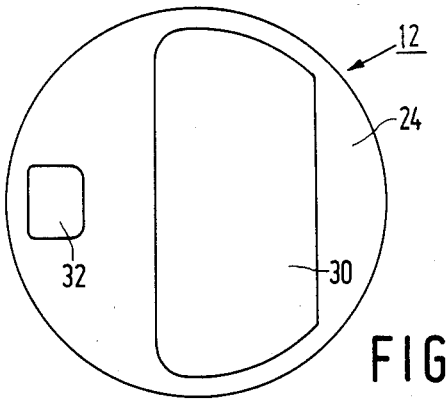
FIG. 3 is a plan view of a metal cooling member, used in the lamp shown in FIGS. 1 and 2.
Figure 2:
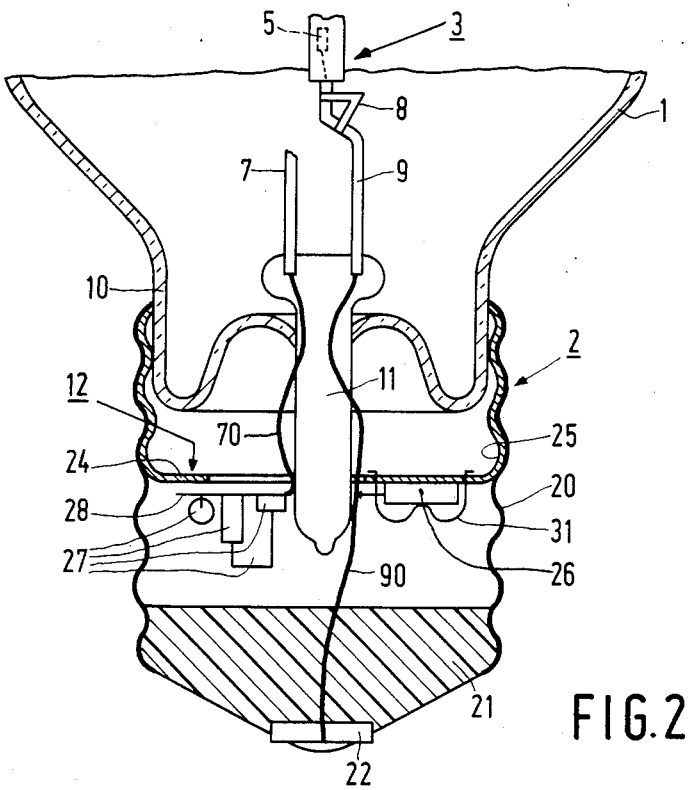
FIG. 2 is a detailed representation of a sectional view of the lamp cap of the lamp shown in FIG. 1.

The plate-shaped part 24 of the cooling member 12, of which a plan view is shown in FIG. 3 (not to scale), is provided with a recess 30 through which an exhaust tube 11 (FIG. 2) of the lamp is passed; the conductors 90 and 70 are also passed through this recess. Moreover, the plate-shaped part 24 is provided with a recess 32 for locking the clamp 31 (FIG. 2) against displacement and so securing the semiconductor switching element to be arranged (FIG. 2).

Figure 4:
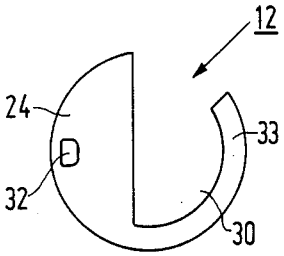
FIG. 4 shows a plan view of another cooling member.

FIG. 4 shows another cooling member not shown to scale, which is for the major part plate-shaped, while the circumference can be resiliently compressed. For this purpose, the plate-shaped part 24 is provided with a strip 33 which is resiliently displaceable with small deviations with respect to the plate-shaped part 24. When the cooling member is arranged in a sleeve of a lamp cap and substantially at right angles to the longitudinal axis of the lamp cap, and this sleeve has an inner dimension which is slightly smaller than the outer dimension of the cooling member 12, the cooling member bears on the sleeve in a self-clamping manner. The recess 30 between the plate-shaped part 24 and the strip-shaped part 33 serves, when mounted in the lamp, to receive the exhaust tube and the electrical conductors. The recess 32 in this embodiment has the same function as in the embodiment shown in FIG. 3.

Figure 5:
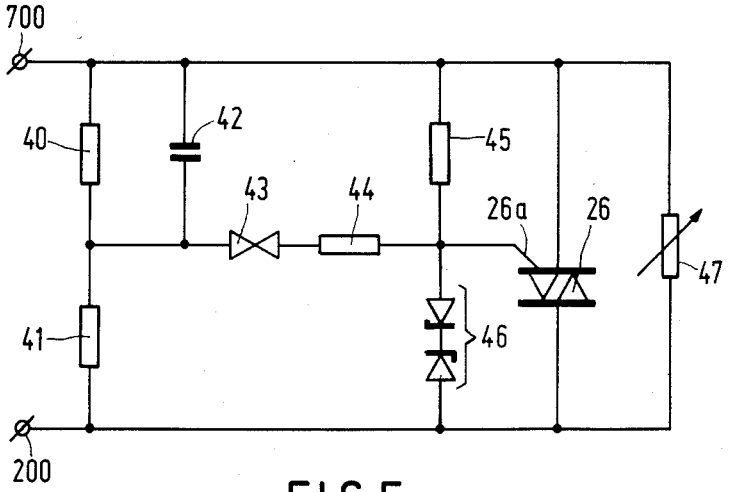
FIG. 5 shows the electric circuit diagram of a circuit arrangement in the lamp cap of the lamp.

FIG. 5 shows an electric circuit diagram of a circuit arrangement, in which a connection terminal 700 is connected to the conductor 70 and a connection terminal 200 is connected to the sleeve 20. The connection terminals 700 and 200 are interconnected through a parallel arrangement of the semiconductor switching element 26 and a temperature-dependent resistor 47. A control electrode **26*a* of the semiconductor switching element 26 is connected to a junction of a series arrangement of a resistor 45 and two Zener diodes 46 arranged in series opposition. The series arrangement is directly connected between the connection terminals 200 and 700**.

Furthermore, the control electrode **26*a* is connected through a resistor 44 and a disc 43 to a voltage divider between the connection terminals 700 and 200 comprising a series arrangement of resistors 40 and 41. The resistor 40 is shunted by a capacitor 42. The circuit arrangement shown is a fixedly adjusted circuit arrangement for limiting the average lamp current, whose operation is as follows. When the lamp is started, the circuit arrangement is shortcircuited between the terminals 200 and 700 through the temperature-dependent resistor 47. In the operating condition, the value of the temperature-dependent resistor has increased so that as a result a "keep-alive" current through the lamp is maintained in the non-conducting state of the switching element 26. Such a keep-alive current maintains the ionization of the filling of the discharge vessel, as a result of which the lamp re-ignites satisfactorily as soon as the switching element 26** becomes conducting.

In the operating condition, a variable voltage is applied across the terminals 200 and 700. When this voltage increases, the voltage at the capacitor 42 will also increase. As soon as this voltage reaches the breakdown voltage of the diac 43, the diac 43 becomes conducting and the capacitor 42 is discharged via the diac 43 and the resistors 44 and 45. A voltage pulse occurs across the resistor 45, which ensures that the switching element 26 is brought into the conducting state. In the conducting state, the switching element 26 forms a connection substantially without impedance between the connection terminals 200 and 700 and the current through the lamp will be limited by the stabilization ballast of the equipment in which the lamp is operated.

The switching element 26 remains conducting until the current has fallen to approximately 0 A, after which in the opposite phase the cycle is repeated.

The firing moment is determined by the resistance ratio of the resistors 40 and 41 and by the capacitor 42.

In a practical embodiment, the circuit arrangement was dimensioned as follows:

| | |
|---|---|
| Resistor 40 | 82 kΩ |
| Resistor 41 | 82 kΩ |
| Resistor 44 | 22 kΩ |
| Resistor 45 | 100 Ω |
| Resistor 47 | 12Ω at 300K<br>12 kΩ at 450K |
| Capacitor 42 | 47 nF |
| Diac 43 | Breakdown voltage 32 V |
| Zener diodes 46 | breakdown voltage 430 V |
| Semiconductor switching element 26 | Triac BT 137. |

In a practical lamp provided with a circuit arrangement of the kind described above, the triac BT 137 is mounted on a copper plate-shaped part of a cooling member 12 which is provided with a flange made of steel, which is secured to the neck 10 of the outer envelope 1 by means of cement. The flange 25 of the cooling member 12 is provided with screw-thread, on which the sleeve of the lamp is secured. The lamp is suitable for operation with a supply source at 220 V, 50 Hz and dissipates 200 W in the operating condition. The lamp is connected in series with a stabilization ballast suitable for operation of a known high-pressure discharge lamp of 250 W. The discharge vessel 3 has a filling consisting of an excess of amalgam comprising 80% by weight of Hg and 20% by weight of Na and xenon at a pressure of 33.3 kPa at 300 K. In the operating condition of the lamp, the temperature of the triac is 110° C. at an ambient temperature of approximately 25° C. The maximum permissible temperature for the triac is 125° C. The lamp has a luminous flux of 25000 lumen, which corresponds to the luminous flux of a conventional high-pressure sodium discharge lamp of 250 W containing xenon as starting gas.

In the case of another lamp, the lamp dissipates in the operating condition a power of 320 W during operation with a stabilization ballast suitable for operation of a known 400 W high-pressure discharge lamp. The filling of the discharge vessel contains besides an excess of amalgam comprising 80% by weight of Hg and 20% by weight of Na, also xenon at a pressure of 27 kPa at 300 K. The temperature of the triac is 118° C. at an ambient temperature of approximately 23° C. The luminous efficacy emitted by the lamp is 135 lm/W.

What is claimed is:

1. A discharge lamp comprising means for defining a discharge current path in the operating condition of the lamp; and a lamp cap having a sleeve defining a longitudinal axis, said cap supporting and providing electrical connections to said means, characterized by comprising an electronic circuit including at least one semiconductor switching element for controlling the discharge current in the operating condition of the lamp, disposed within said lamp cap, and means for transferring heat from said element to said sleeve by thermal conduction, said means for transferring comprising a body which is a cooling member.

2. A lamp as claimed in claim 1, characterized in that the cooling member is a metal body which is directly connected to said sleeve.

3. A lamp as claimed in claim 2, in which said lamp cap comprises an insulating bead at an end of the sleeve remote from said discharge defining means, characterized in that said element is disposed between said body and said bead, and said body has a plate portion to which said element is mounted, and an edge flange extending from said plate portion away from said bead, said flange being directly connected to said sleeve.

4. A lamp as claimed in claim 2, characterized in that said body comprises a plate portion constituting a major part of the body, and a resilient circumferential portion arranged to bear against said sleeve in a clamping manner, said plate portion having major surfaces which are substantially perpendicular to said axis.

5. A high-pressure discharge lamp comprising means, including a discharge vessel, for defining a discharge current path in the operating condition of the lamp; a lamp cap having a sleeve defining a longitudinal axis, said cap supporting and providing electrical connections to said means, and an outer envelope enclosing said vessel and having a neck which said sleeve adjoins, characterized by comprising an electronic circuit including at least one semiconductor switching element for controlling the discharge current in the operating condition of the lamp, disposed within said lamp cap, and means for transferring heat from said element to said sleeve by thermaal conduction, said means for transferring comprising a body which is a cooling member.

6. A lamp as claimed in claim 5, characterized in that the cooling member is a metal body which is directly connected, electrically and mechanically, to said sleeve.

7. A lamp as claimed in claim 6, characterized in that said metal body has a plate-shaped part disposed near said outer envelope neck, said part having major surfaces oriented substantially perpendicularly to said longitudinal axis.

8. A lamp as claimed in claim 7, in which said lamp cap comprises an insulating bead at an end of the sleeve remote from said discharge defining means, charaterized in that said element is arranged between the body and said bead, and said body has a plate portion to which said element is mounted, and an edge flange disposed between and in contact with said neck and said sleeve, and extending from said plate portion away from said bead.

9. A lamp as claimed in claim 7, characterized in that said cap comprises an insulating bead disposed remote from said envelope, said switching element being arranged between said metal body and said bead.

10. A lamp as claimed in claim 5, characterized in that said body comprises a plate portion constituting a major part of the body, and a resilient circumferential portion arranged to bear against said sleeve in a clamping manner, said plate portion having major surfaces which are substantially perpendicular to said axis.

11. A high-pressure discharge lamp comprising means, including a discharge vessel, for defining a discharge current path in the operating condition of the lamp; a lamp cap having a sleeve defining a longitudinal axis, said cap supporting and providing electrical connections to said means, and an outer envelope enclosing said vessel and having a neck which said sleeve adjoins, characterized by comprising electronic means permitting operation of said lamp from a stabilization ballast adapted for operation of a lamp having different characteristics, said electronic means including a semiconductor switching element, disposed within said lamp cap, and means for transferring heat from said element to said sleeve by thermal conduction, said means for transferring comprising a body which is a cooling member.

12. A lamp as claimed in claim 11, characterized in that the cooling member is a metal body which is directly connected, electrically and mechanically, to said sleeve.

13. A lamp as claimed in claim 12, characterized in that said metal body has a plate-shaped part disposed near said outer envelope neck, said part having major surfaces oriented substantially perpendicularly to said longitudinal axis.

14. A lamp as claimed in claim 12, in which said lamp cap comprises an insulating bead at an end of the sleeve remote from said discharge defining means, characterized in that said element is arranged between the body and said bead, and said body has a plate portion to which said element is mounted, and an edge flange disposed between and in contact with said neck and said sleeve, and extending from said plate portion away from said bead.

15. A lamp as claimed in claim 13, characterized in that said cap comprises an insulating bead disposed remote from said envelope, said switching element being arranged between said metal body and said bead.

16. A lamp as claimed in claim 11, characterized in that said body comprises a plate portion constituting a major part of the boddy, and a resilient circumferential portion arranged to bear against said sleeve in a clamping manner, said plate portion having major surfaces which are substantially perpendicular to said axis.

* * * * *